US005775605A

United States Patent [19]

Tsai

[11] Patent Number: 5,775,605

[45] Date of Patent: Jul. 7, 1998

[54] SHREDDING MACHINE WITH CONTACT-TYPE CONTROL SWITCH ASSEMBLY

[76] Inventor: Shao-Nong Tsai, No. 17, Lane 267, Hua-Chen Rd., Hsin-Chuang City, Taipei Hsien, Taiwan

[21] Appl. No.: 865,347

[22] Filed: May 29, 1997

[30] Foreign Application Priority Data

Apr. 9, 1997 [TW] Taiwan ..... 86205507

[51] Int. Cl.[6] ..... B02C 18/24; B02C 18/40

[52] U.S. Cl. ..... 241/36; 241/100; 241/236

[58] Field of Search ..... 241/33, 36, 100, 241/236

[56] References Cited

U.S. PATENT DOCUMENTS

| | | | |
|---|---|---|---|
| 4,200,239 | 4/1980 | Simone et al. | 241/36 |
| 5,167,374 | 12/1992 | Strohmeyer | 241/36 |
| 5,188,301 | 2/1993 | Hasegawa | 241/33 |
| 5,236,138 | 8/1993 | Stangenberg et al. | 241/36 |
| 5,429,313 | 7/1995 | Schwelling | 241/36 |
| 5,538,193 | 7/1996 | Takahashi et al. | 241/33 |
| 5,662,280 | 9/1997 | Nishio et al. | 241/30 |

*Primary Examiner*—John M. Husar
*Attorney, Agent, or Firm*—Townsend and Townsend and Crew LLP

[57] ABSTRACT

A shredding machine includes a machine housing having a top wall formed with an inlet, a cutting device disposed in the housing adjacent to the inlet, and a contact-type control switch assembly mounted on the top wall of the housing and connected electrically to the cutting device. The control switch assembly includes a multi-position slide switch with a slider, and a contact switch. The top wall of the housing is formed with an access hole having a front portion adjacent to the inlet and aligned with the contact switch, and a rear portion distant from the inlet and aligned with the slide switch. A switch actuator unit includes a slider actuator that is mounted slidably in the rear portion of the access hole and that engages the slider, and a contact arm actuator connected to the slider actuator and disposed in the front portion of the access hole. The slider actuator is movable in the access hole so as to move the slider between first and second switch positions and so as to move the contact arm actuator between an extended position, where the contact arm actuator extends into the inlet, and a retracted position, where the contact arm actuator ceases to extend substantially into the inlet.

11 Claims, 3 Drawing Sheets

SHREDDING MACHINE WITH CONTACT-TYPE CONTROL SWITCH ASSEMBLY

BACKGROUND OF THE INVENTION

1. Field of the Invention

The invention relates to a shredding machine, more particularly to a shredding machine that is provided with a contact-type control switch assembly.

2. Description of the Related Art

Shredding machines are widely used in the destruction of confidential documents and in forming shredded paper to be used as a protective packaging filler in boxes.

One example of a conventional shredding machine employs a manual power switch which is operable so as to activate or deactivate a cutting device. In the event of a paper jam, the power switch is operable so as to activate the cutting device in a reverse mode in order to release the cutting device from the paper jam condition. One drawback of the conventional shredding machine resides in that accidents due to negligence can easily occur since the cutting device remains activated as long as the power switch is in the ON position.

Another example of a conventional shredding machine utilizes an electronic sensor for automatically activating the cutting device upon detection of the presence of a paper sheet in an inlet of the shredding machine, and for automatically deactivating the cutting device upon detecting the presence of a paper jam. The shredding machine is further provided with a manual control switch for operating the cutting device in the reverse mode to release the cutting device from the paper jam condition. Aside from being expensive, this shredding machine cannot be used to shred relatively small pieces of paper due to failure of the electronic sensor to detect the same.

In still another example of a conventional shredding machine, the electronic sensor is replaced with a mechanical contact switch having a contact arm which extends into the inlet of the shredding machine such that, when a sheet of paper is fed into the inlet and depresses the contact arm, the contact switch activates the cutting device to initiate shredding of the paper sheet. Although the use of the mechanical contact switch results in a less expensive structure as compared to one which uses the electronic sensor, the conventional shredding machine with the mechanical contact switch still suffers from some drawbacks. Particularly, when a paper jam occurs and the cutting device is operated in the reverse mode so as to release the same from the paper jam condition, the contact arm of the contact switch is easily bent or broken by the paper sheets in the inlet since the contact arm always extends into the inlet.

SUMMARY OF THE INVENTION

The main object of the present invention is to provide a shredding machine with a contact-type control switch assembly which is not adversely affected by the reverse mode operation of the cutting device when the latter is being released from a paper jam condition.

Another object of the present invention is to provide a shredding machine with a contact-type control switch assembly which permits manual or automatic control of the cutting device.

According to the present invention, a shredding machine comprises a machine housing having a top wall formed with a paper feed inlet, a cutting device disposed in the machine housing adjacent to the inlet, and a contact-type control switch assembly mounted on the top wall of the machine housing and connected electrically to the cutting device. The control switch assembly includes a multi-position slide switch provided with a slider that is movable between first and second switch positions, and a contact switch provided with a movable contact arm.

The top wall of the machine housing is formed with an access hole which has a front portion adjacent to the inlet and aligned with the contact switch, and a rear portion distant from the inlet and aligned with the slide switch.

A switch actuator unit includes a slider actuator that is mounted slidably in the rear portion of the access hole and that engages the slider of the slide switch, and a contact arm actuator that is disposed in the front portion of the access hole and that has a rear part connected to the slider actuator and a front part. The slider actuator is movable in the access hole so as to move the slider of the slide switch between the first and second switch positions and so as to move the front part of the contact arm actuator between an extended position, where the front part of the contact arm actuator extends into the inlet so as to be adapted to be depressed by a sheet of paper fed into the inlet in order to enable the contact arm actuator to depress the movable contact arm of the contact switch and activate the cutting device automatically to initiate shredding of the sheet of paper, and a retracted position, where the front part of the contact arm actuator ceases to extend substantially into the inlet to prevent the contact arm actuator from depressing the movable contact arm of the contact switch when a sheet of paper is fed into the inlet and to prevent damage to the front part of the contact arm actuator when the cutting device is operated in a reverse mode to release the cutting device from a paper jam condition.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
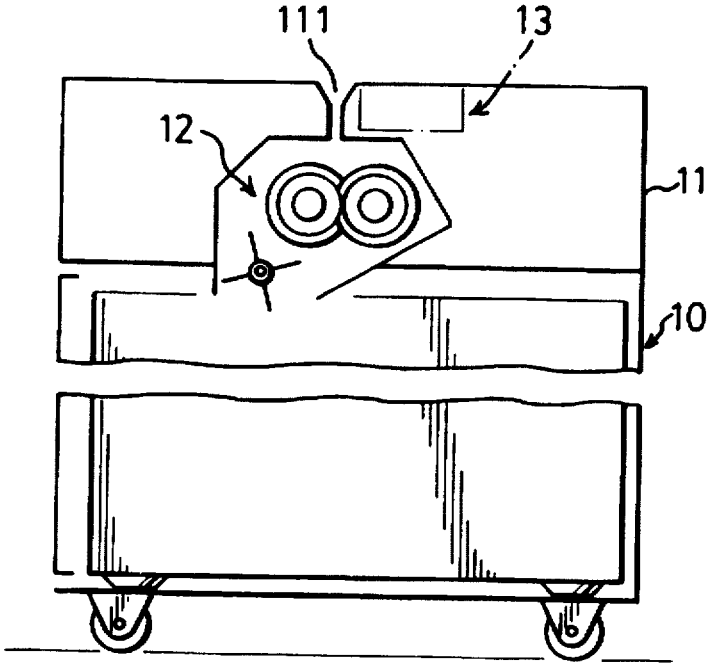
FIG. 1 is a schematic view of the preferred embodiment of a shredding machine with a contact-type control switch assembly according to the present invention.

Referring to FIG. 1, the preferred embodiment of a shredding machine 10 according to the present invention is shown to comprise a machine housing 11 which has a top wall formed with a paper feed inlet 111, a cutting device 12 disposed in the machine housing 11 adjacent to the inlet 111, and a contact-type control switch assembly 13 mounted on the top wall of the machine housing 11 and connected electrically to the cutting device 12. The control switch assembly 13 includes a circuit board 130 disposed inside the machine housing 11 and mounted on the top wall adjacent to the inlet 111, and a multi-position slide switch 131 and a contact switch 132 mounted on the circuit board 130. The slide switch 131 is known in the art and is provided with a slider 1311 on a top side. In this embodiment, the slide switch 131 is a two-position switch for controlling operation of the cutting device 12 in an automatic (AUTO) mode and in an OFF/REVERSE mode. It should be noted, however, that the slide switch 131 may be implemented as a three-position switch for controlling operation of the cutting device 12 in the AUTO mode, the OFF mode and in the REVERSE mode. For the sake of brevity, only a two-position switch will be described in the succeeding paragraphs. The contact switch 132 is similarly known in the art and is provided with a movable contact arm 1321 on a top side.

The top wall of the machine housing 11 is formed with an access hole 14 which has a front portion 1411 adjacent to the inlet 111 and aligned with the contact switch 132, and a rear portion distant from the inlet 111 and aligned with the slide switch 131. The rear portion is formed with a hole bottom 141 which is provided with a longitudinal slide slit 1412 that extends in a direction from the front portion 1411 to the rear portion of the access hole 14 and that permits extension of the slider 1311 of the slide switch 131 thereinto. The rear portion of the access hole 14 further has opposite side walls formed with longitudinal guide slots 142, and a rear wall formed with an insert slot 143.

The control switch assembly 13 further comprises a switch actuator unit which includes a slider actuator 20 and a contact arm actuator 30.

Figure 2:
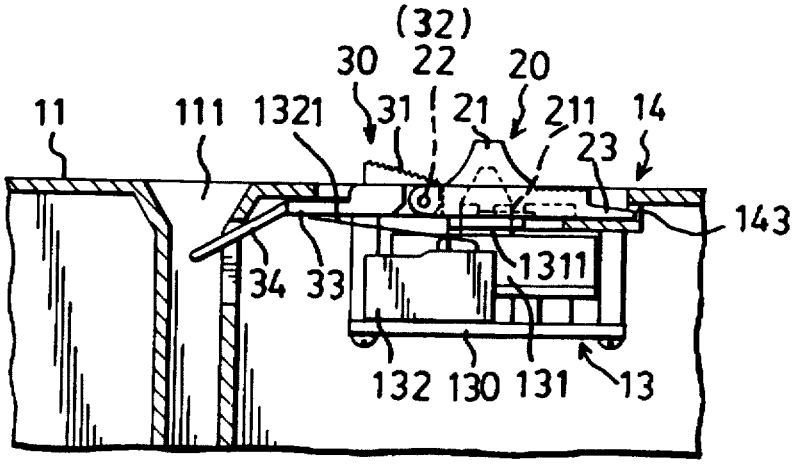
FIG. 2 is a sectional view which illustrates the control switch assembly of the preferred embodiment in an extended state.
Figure 3:
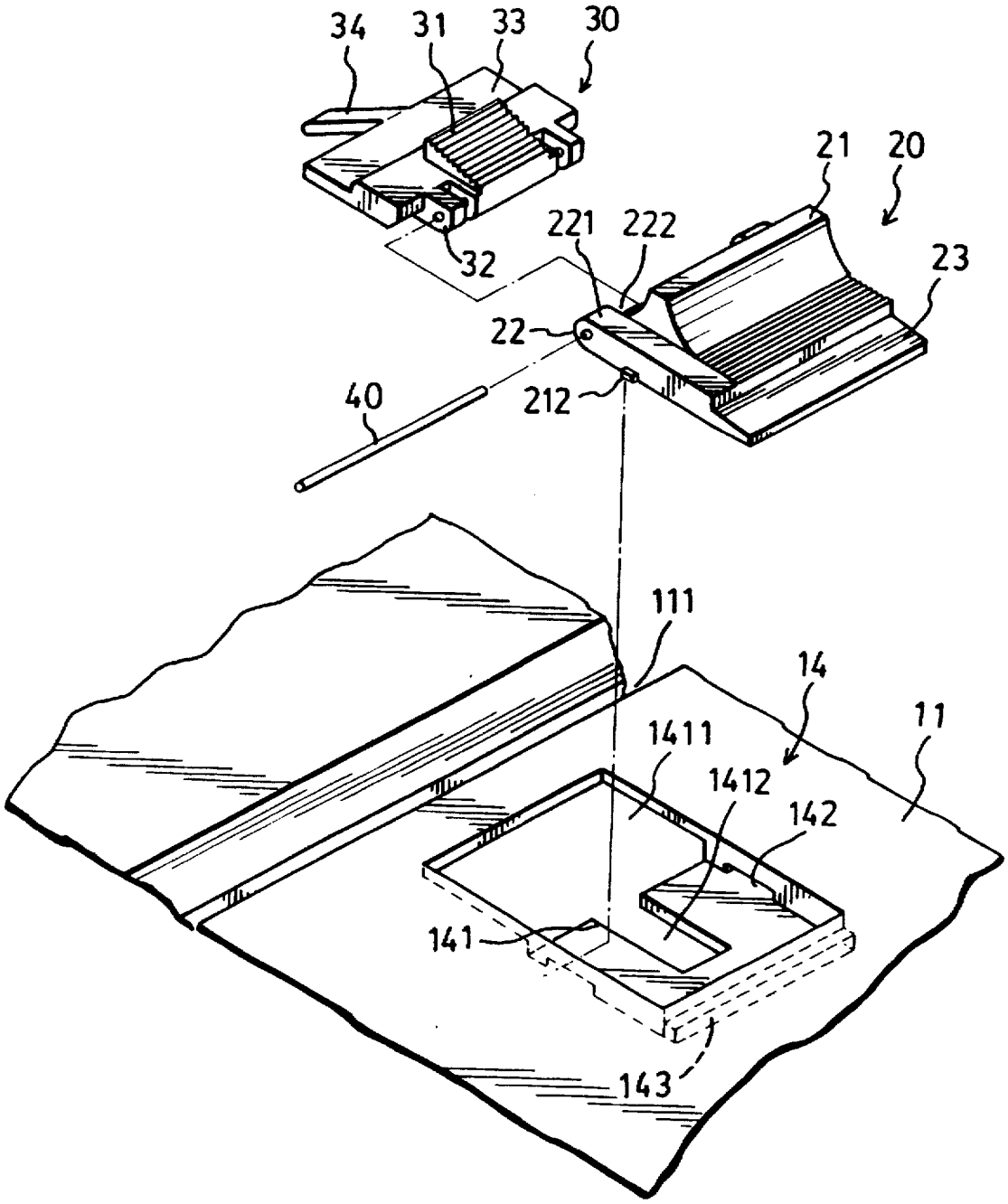
FIG. 3 is an exploded view of a switch actuator unit of the control switch assembly of the preferred embodiment.
Figure 4:
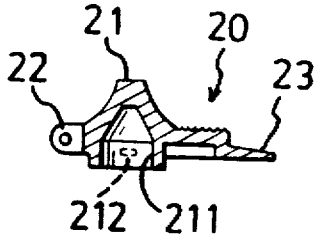
FIG. 4 is a sectional view of a slider actuator of the switch actuator unit shown in FIG. 3.

As shown in FIGS. 2, 3 and 4, the slider actuator 20 is mounted slidably in the rear portion of the access hole 14 and has a top side formed with an upwardly extending finger operating unit 21, a bottom side formed with a slider engaging unit 211 for engaging the slider 1311 which extends through the slit 1412 in the hole bottom 141, opposite lateral sides formed with a respective key projection 212 that engages slidably a corresponding one of the guide slots 142, a front part formed with a pivot unit 22, and a rear part formed with a limit projection 23 which is extends into the insert slot 143 to prevent vertical movement of the slider actuator 20 on the hole bottom 141 when the slider actuator 20 is slid along the access hole 14. The pivot unit 22 includes a pair of forwardly extending pivot lugs 221 which form a receiving space 222 therebetween.

The contact arm actuator 30 is in the front portion 1411 of the access hole 14 and has a top side formed with an upwardly extending and rearwardly tapering finger operating unit 31, a rear part formed with a pivot member 32 which extends into the receiving space 222 between the pivot lugs 221 for pivotal connection therewith, and a front part which includes a horizontal section 33 that is disposed below the top wall of the machine housing 11 and that has a front edge, and a downwardly and forwardly inclining section 34 that extends from the front edge of the horizontal section 33. Preferably, the horizontal section 33 has a width that corresponds to that of the front portion 1411 of the access hole 14 so as to cover the same.

During installation of the contact switch assembly 13, the pivot member 32 of the contact arm actuator 30 is pivoted to the pivot unit 22 of the slider actuator 20 with the use of a pivot pin 40. Then, the slider actuator 20 and the contact arm actuator 30 are disposed respectively in the rear and front portions of the access hole 14 such that the horizontal section 33 of the front part of the contact arm actuator 30 is disposed below the top wall of the machine housing 11 while the inclining section 34 of the same extends toward the inlet 111 of the machine housing 11, and such that the slider engaging unit 211 of the slider actuator 20 engages the slider 1311 of the slide switch 131, the key projections 212 engage slidably the guide slots 142, and the limit projection 23 extends into the insert slot 143 to prevent vertical movement of the slider actuator 20 on the hole bottom 141 at the rear portion of the access hole 14, as shown in FIG. 2.

When the finger operating unit 21 on the top side of the slider actuator 20 is pushed forwardly toward the inlet 111 of the machine housing 11, the slider 1311 of the slide switch 131 is moved to a first switch position for operating the cutting device 12 in the AUTO mode. At this time, the distal end of the movable contact arm 1321 of the contact switch 132 is disposed immediately below the horizontal section 33 of the contact arm actuator 30, while the inclining section 34 of the contact arm actuator 30 extends into the inlet 111 of the machine housing 11, thereby locating the contact arm actuator 30 in an extended position. When a sheet of paper is fed into the inlet 111, the inclining section 34 is depressed and causes the contact arm actuator 30 to pivot downwardly relative to the slider actuator 20, thereby depressing the movable contact arm 1321 of the contact switch 132. The contact switch 132 activates the cutting device 12 automatically to initiate shredding of the paper sheet.

In the event that the paper sheet is relatively small such that it is unable to depress the inclining section 34 of the contact arm actuator 30, the finger operating unit 31 of the contact arm actuator 30 can be manually depressed so as to force the latter to pivot relative to the slider actuator 20 and enable the horizontal section 33 to depress the contact arm 1321 of the contact switch 132 and activate the cutting device 12.

Figure 5:
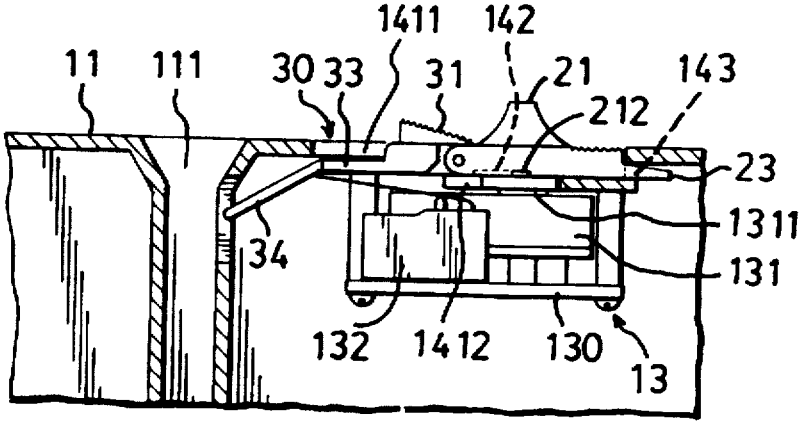
FIG. 5 is a sectional view which illustrates the control switch assembly of the preferred embodiment in a retracted state.

Referring to FIG. 5, when the finger operating unit 21 of the slider actuator 20 is pushed rearwardly away from the inlet 111 of the machine housing 11, the slider 1311 is moved to a second switch position for operating the cutting device 12 in the OFF/REVERSE mode. At this time, the inclining section 34 ceases to extend substantially into the inlet 111 of the machine housing 11, thereby locating the contact arm actuator 30 in a retracted position. Thus, the contact arm actuator 30 does not depress the movable contact arm 1321 of the contact switch 132 when a sheet of paper is fed into the inlet 111. Preferably, the hole bottom 141 has a length sufficient to support the rear part of the contact arm actuator 30 thereon when the latter is in the retracted position in order to prevent erroneous downward pivoting movement of the same relative to the slider actuator 20. In this embodiment, which uses a two-position switch for the slide switch 131, when a paper jam occurs, the slider 1311 is placed in the second switch position so that the cutting device 12 can be operated in the REVERSE mode in order to release the same from the paper jam condition. Since the inclining section 34 of the switch actuator 30 ceases to extend substantially into the inlet 111, the switch actuator 30 is neither bent nor broken by the paper sheets in the inlet 111 during the REVERSE mode operation of the cutting device. If the slide switch 131 is implemented as a three-position switch, when a paper jam occurs, the slider 1311 is placed in the REVERSE switch position so that the cutting device 12 can be operated in the REVERSE mode in order to release the same from the paper jam condition. The switch actuator 30 is prevented from depressing the contact arm 1321 of the contact switch 132, and the inclining section 34 of the switch actuator 30 ceases to extend substantially into the inlet 111 to avoid bending or breaking of the same during the REVERSE mode operation of the cutting device 12.

Since the particular electrical connection between the switches 131, 132 and the cutting device 12 is known in the art, and since the feature of the present invention does not reside therein, a detailed description of the same will be dispensed with herein.

It has thus been shown that the contact-type control switch assembly 13 of the shredding machine 10 of this invention is not adversely affected by the reverse mode operation of the cutting device 12 when the latter is being released from a paper jam condition, and permits manual or automatic control of the cutting device 12. The objects of the present invention are thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A shredding machine comprising:

a machine housing having a top wall formed with a paper feed inlet;

a cutting device disposed in said machine housing adjacent to said inlet; and a contact-type control switch assembly mounted on said top wall of said machine housing and connected electrically to said cutting device, said control switch assembly including a multi-position slide switch provided with a slider that is movable between first and second switch positions, and a contact switch provided with a movable contact arm;

wherein said top wall of said machine housing is formed with an access hole which has a front portion adjacent to said inlet and aligned with said contact switch, and a rear portion distant from said inlet and aligned with said slide switch;

said control switch assembly further including a switch actuator unit which includes a slider actuator that is mounted slidably in said rear portion of said access hole and that engages said slider of said slide switch, and a contact arm actuator that is disposed in said front portion of said access hole and that has a rear part connected to said slider actuator and a front part, said slider actuator being movable in said access hole so as to move said slider of said slide switch between said first and second switch positions and so as to move said front part of said contact arm actuator between an extended position, where said front part of said contact arm actuator extends into said inlet so as to be adapted to be depressed by a sheet of paper fed into said inlet in order to enable said contact arm actuator to depress said movable contact arm of said contact switch and activate said cutting device automatically to initiate shredding of the sheet of paper, and a retracted position, where said front part of said contact arm actuator ceases to extend substantially into said inlet to prevent said contact arm actuator from depressing said movable contact arm of said contact switch when a sheet of paper is fed into said inlet and to prevent damage to said front part of said contact arm actuator when said cutting device is operated in a reverse mode to release said cutting device from a paper jam condition.

2. The shredding machine of claim 1, wherein said rear portion of said access hole is formed with a hole bottom which is provided with a longitudinal slide slit that extends in a direction from said front portion to said rear portion of said access hole and that permits extension of said slider of said slide switch thereinto, said rear portion of said access hole further having opposite side walls formed with longitudinal guide slots, and a rear wall formed with an insert slot.

3. The shredding machine of claim 2, wherein said slider actuator has a top side formed with an upwardly extending finger operating unit, a bottom side formed with a slider engaging unit for engaging said slider which extends through said slit in said hole bottom, opposite lateral sides formed with a respective key projection that engages slidably a corresponding one of said guide slots, a front part connected to said rear part of said contact arm actuator, and a rear part formed with a limit projection which extends into said insert slot to prevent vertical movement of said slider actuator on said hole bottom when said slider actuator is slid along said access hole.

4. The shredding machine of claim 3, wherein said rear part of said contact arm actuator is connected pivotally to said slider actuator, said front part of said contact arm actuator including a horizontal section that is disposed below said top wall of said machine housing and that has a front edge, and a downwardly and forwardly inclining section that extends from said front edge of said horizontal section and into said inlet of said machine housing in the extended position.

5. The shredding machine of claim 4, wherein said horizontal section has a width that corresponds to that of said front portion of said access hole so as to cover said front portion of said access hole.

6. The shredding machine of claim 4, wherein said hole bottom has a length sufficient to support said rear part of said contact arm actuator thereon when said contact arm actuator is in the retracted position in order to prevent erroneous downward pivoting movement of said contact arm actuator relative to said slider actuator.

7. The shredding machine of claim 4, wherein said contact arm actuator has a top side formed with an upwardly extending and rearwardly tapering finger operating unit to facilitate manual depressing of said contact arm actuator.

8. The shredding machine of claim 1, wherein said rear part of said contact arm actuator is connected pivotally to said slider actuator, said front part of said contact arm actuator including a horizontal section that is disposed below said top wall of said machine housing and that has a front edge, and a downwardly and forwardly inclining section that extends from said front edge of said horizontal section and into said inlet of said machine housing in the extended position.

9. The shredding machine of claim 8, wherein said horizontal section has a width that corresponds to that of said front portion of said access hole so as to cover said front portion of said access hole.

10. The shredding machine of claim 8, wherein said hole bottom has a length sufficient to support said rear part of said contact arm actuator thereon when said contact arm actuator is in the retracted position in order to prevent erroneous downward pivoting movement of said contact arm actuator relative to said slider actuator.

11. The shredding machine of claim 8, wherein said contact arm actuator has a top side formed with an upwardly extending and rearwardly tapering finger operating unit to facilitate manual depressing of said contact arm actuator.

* * * * *